US011191687B2

(12) United States Patent
Sachdev et al.

(10) Patent No.: US 11,191,687 B2
(45) Date of Patent: Dec. 7, 2021

(54) PORTABLE CUSHION AND METHOD OF USE

(71) Applicants: Harikrishan S. Sachdev, Laredo, TX (US); Koushalya S. Sachdev, Laredo, TX (US)

(72) Inventors: Harikrishan S. Sachdev, Laredo, TX (US); Koushalya S. Sachdev, Laredo, TX (US)

( * ) Notice: Subject to any disclaimer, the term of this patent is extended or adjusted under 35 U.S.C. 154(b) by 146 days.

(21) Appl. No.: 16/527,524

(22) Filed: Jul. 31, 2019

(65) Prior Publication Data

US 2019/0350786 A1 Nov. 21, 2019

Related U.S. Application Data

(63) Continuation-in-part of application No. 15/582,658, filed on Apr. 29, 2017, now Pat. No. 10,555,848.

(51) Int. Cl.

| | |
|---|---|
| ***A61G 7/057*** | (2006.01) |
| ***A47C 27/08*** | (2006.01) |
| ***A47C 27/10*** | (2006.01) |
| ***A61G 5/10*** | (2006.01) |
| ***A47C 31/00*** | (2006.01) |
| *A47C 27/18* | (2006.01) |

(52) U.S. Cl.

CPC ..... *A61G 7/05769* (2013.01); *A47C 27/082* (2013.01); *A47C 27/083* (2013.01); *A47C 27/10* (2013.01); *A47C 31/008* (2013.01); *A61G 5/1043* (2013.01); *A61G 5/1045* (2016.11); *A61G 7/05776* (2013.01); *A47C 27/18* (2013.01)

(58) Field of Classification Search

CPC ..... A47C 27/08; A47C 27/081; A47C 27/082; A47C 27/083; A47C 27/10; A47C 31/008; A47C 4/54; A47C 7/021; A61G 7/05769; A61G 7/05776; A61G 5/1043; A61G 5/1045

USPC ..... 5/654, 652, 653, 655.3, 706, 710, 713, 5/644; 297/452.41

See application file for complete search history.

(56) References Cited

U.S. PATENT DOCUMENTS

| | | | | |
|---|---|---|---|---|
| 3,987,507 | A | 10/1976 | Hall | |
| 4,842,330 | A | 6/1989 | Jay | |
| 4,930,171 | A | 6/1990 | Frantz | |
| 5,369,829 | A | 4/1994 | Jay | |
| 5,457,833 | A | 10/1995 | Jay | |
| 5,473,313 | A | 12/1995 | Graebe, Jr. | |
| 5,487,197 | A | 1/1996 | Iskra | |
| 5,509,154 | A * | 4/1996 | Shafer | A47C 27/082 5/713 |
| 5,592,706 | A | 1/1997 | Pearce | |
| 5,606,754 | A | 3/1997 | Hand | |
| 5,652,484 | A * | 7/1997 | Shafer | A47C 27/082 318/16 |

(Continued)

FOREIGN PATENT DOCUMENTS

| | | |
|---|---|---|
| CN | 200420104890 | 10/2004 |
| EP | 0041037 | 12/1981 |

*Primary Examiner* — Robert G Santos

(74) *Attorney, Agent, or Firm* — Stephens Domnitz Meineke, PLLC; Ira P. Domnitz

(57) ABSTRACT

An inflatable cushion comprising; a cover; a base; a communication device; a microcontroller; a power source; a gas pump; a primary tube; a blow off valve; two-way valves; a plurality of secondary tubes; and a plurality of bladder pods with pressure sensors.

17 Claims, 7 Drawing Sheets

(56) References Cited

U.S. PATENT DOCUMENTS 5,657,499 A * 8/1997 Vaughn ..... A61G 7/057 5/654
5,800,480 A 8/1998 Augustine
5,829,081 A 11/1998 Pearce
5,836,654 A 11/1998 DeBellis
5,839,140 A 11/1998 Wilkerson
5,857,749 A 1/1999 DeBellis
5,903,941 A * 5/1999 Shafer ..... F04D 27/004 5/697
6,014,784 A 1/2000 Taylor
6,033,432 A 3/2000 Augustine
6,037,723 A * 3/2000 Shafer ..... A47C 27/082 318/6
6,092,249 A 7/2000 Kamen
6,098,000 A * 8/2000 Long ..... A47C 4/54 701/49
6,483,264 B1 * 11/2002 Shafer ..... A47C 27/082 318/16
6,560,803 B2 * 5/2003 Zur ..... A61G 5/1043 297/284.6
8,042,206 B2 * 10/2011 Genaro ..... A61B 5/1115 5/424
8,117,701 B2 * 2/2012 Bobey ..... A61B 5/6891 5/713
8,312,569 B2 11/2012 Myers
8,464,380 B2 * 6/2013 Bobey ..... A61G 7/05 5/713
8,545,464 B2 10/2013 Weston
8,602,271 B2 12/2013 Winker et al.
8,832,886 B2 * 9/2014 Riley ..... A47C 27/083 5/713
9,220,650 B2 * 12/2015 Bobey ..... A61G 7/05
9,271,579 B2 * 3/2016 Riley ..... A47C 27/18
9,468,307 B2 * 10/2016 Lafleche ..... A61B 5/6892
9,814,637 B2 * 11/2017 Sazonov ..... G01L 5/00
10,555,848 B2 * 2/2020 Sachdev ..... A61G 7/05776
10,561,550 B2 * 2/2020 Bobey ..... A61B 5/6891
10,682,273 B2 * 6/2020 Lafleche ..... A61B 5/6892
10,856,668 B2 * 12/2020 Ye ..... A47C 21/006
2002/0027384 A1 * 3/2002 Zur ..... A61G 5/1091 297/452.41
2009/0237264 A1 * 9/2009 Bobey ..... A61B 5/6891 340/815.69
2009/0265857 A1 10/2009 Habbegger
2011/0061164 A1 * 3/2011 Genaro ..... A61B 5/1115 5/424
2012/0105233 A1 * 5/2012 Bobey ..... A61G 7/05776 340/573.4
2013/0031725 A1 * 2/2013 Riley ..... A47C 27/083 5/713
2013/0276237 A1 * 10/2013 Bobey ..... A61B 5/6891 5/658
2014/0059781 A1 * 3/2014 Lafleche ..... A61B 5/0205 5/713
2014/0298588 A1 * 10/2014 Riley ..... A47C 27/10 5/709
2015/0351981 A1 * 12/2015 Sazonov ..... G01L 5/00 297/217.2
2016/0095774 A1 * 4/2016 Bobey ..... A61G 7/05 5/658
2017/0027792 A1 * 2/2017 Lafleche ..... A61B 5/6892
2018/0289174 A1 * 10/2018 Ye ..... A61G 7/05776
2018/0311089 A1 11/2018 Sachdev
2019/0290016 A1 * 9/2019 Miller, Jr. ..... A61G 7/05776
2019/0350786 A1 * 11/2019 Sachdev ..... A61G 5/1043
2020/0146909 A1 * 5/2020 Bobey ..... A61G 7/05776
2020/0297564 A1 * 9/2020 Lafleche ..... A61G 7/05769
2021/0059426 A1 * 3/2021 Bussert ..... B60N 2/976
2021/0113402 A1 * 4/2021 Wijesundara ..... A47C 7/142

* cited by examiner

PORTABLE CUSHION AND METHOD OF USE

CROSS-REFERENCE TO RELATED APPLICATIONS

This application is a continuation-in-part of, and claims priority to, pending U.S. Nonprovisional application Ser. No. 15/582,658, filed Apr. 29, 2017, titled "Portable Cushion and Method of Use," the entire contents of which are hereby incorporated by reference.

STATEMENT REGARDING FEDERALLY SPONSORED RESEARCH

Not applicable.

BACKGROUND

Pressure ulcers continue to plague the lives of paraplegics, quadriplegics, bed-ridden patients, the disabled, et al. Pressure ulcers, also known as pressures sores, bedsores, and decubitus ulcers, are localized injuries to the skin or underlying tissue that usually occur over a bony prominence as a result of pressure, or pressure in combination with shear and/or friction. Approximately one to three million people in the United States will develop pressure ulcers each year, and about sixty thousand people will die from pressure ulcer complications annually.

Based on current events, it is anticipated that the responsibility for individuals and providers to prevent and cater to pressure ulcers is much greater. One solution is said to exist: relieving skin pressure over a bony prominence for five minutes every two hours, which will allow adequate perfusion and prevent tissue breakdown.

In one embodiment of the present invention, in order to overcome the problem of pressure sores and to contribute to a solution, a seating system in the form of a deflatable wheelchair cushion, divided into multiple compartments, is being proposed. In some embodiments, the wheelchair cushion contains a sand based top layer and an air pump that deflates one compartment at a time in a rotating motion. Thus, a portion of the user's buttocks will be continually relieved for fifteen minutes over a two-hour cycle.

In several embodiments, the present invention is different from the ones on the market in several ways: it is connected to a microcontroller and a network of sensors that react to the areas of high pressure by inflating and deflating areas of the cushion, rotates air constantly throughout the chair, and is connected to a communication device to provide optional user feedback. The products on the market do not provide those features.

In several embodiments of the present invention, the present invention is an inflatable cushion, for use in multiple applications, comprising; a cover; a base; a communication device; a microcontroller; a power source; a gas pump; a primary tube; a blow off valve; two-way valves; a plurality of secondary tubes; and a plurality of bladder pods with pressure sensors.

One prior art piece Habegger—US 2009/0265857 operates with individual pressure compartments that are not connected. Habegger also utilizes a foam cylinder, spring elements, and multiple inflatable layers; all of which are not found in the present invention. In several embodiments, the present invention is connected to a microcontroller, has a network of sensors, inflates in response to data from sensors, and has two-way valves.

Another piece of prior art, Weston U.S. Pat. No. 8,545,464, operates as a wound treatment apparatus. Weston utilizes a "cover with protrusions on its surface for purposes of monitoring pressure"; this is not found in the present invention. In several embodiments, the present invention is designed to prevent the development of pressure ulcers.

A third piece of prior art, Myers et al. U.S. Pat. No. 8,312,569, functions as an apparel garment with a padded portion. The invention of Myers is not a cushion, and there are no compartments, unlike the present invention.

One other piece of prior art is Winker et al. U.S. Pat. No. 8,602,271, ("Winker") which is designed for patients with wounds and for the purpose of treating existing wounds. Winker contains a fluid impermeable membrane, a "cover with protrusions on its surface," an absorbable matrix," and a feature to monitor temperature: all of which is not found in the present invention. In many embodiments, the present invention has air compression and air bladders, unlike Winker. In many embodiments, the present invention is connected to a microcontroller, unlike Winker.

Kamen et al.—U.S. Pat. No. 6,092,249, utilizes hollow foam members that does not have the constant air circulation of several embodiments of the present invention.

Augustine et al., U.S. Pat. No. 6,033,432, is different from the present invention because it is solely for selectively cooling weight-bearing areas of the body in order to prevent or reduce damage. Taylor et al., U.S. Pat. No. 6,014,784, operates on a "timing" system, unlike several embodiments of the present invention. In several embodiments of the present invention, the present invention employs a plurality of sensors that provide feedback to a microcontroller, which then determines the inflation patterns. Wilkerson, U.S. Pat. No. 5,839,140, uses fluid-fillable cells rising from the base member. Wilkerson has a layer of cells that contain liquids in them. In several embodiments, the present invention is filled with air and uses an air compressor. The present invention has bladders that, without air or a gas, would be empty. The present invention, in several embodiments, has a top layer of padding above the plurality of bladders. DeBellis et al., U.S. Pat. No. 5,857,749, is not compartmentalized and maintains a uniformed pressure throughout the whole cushion. The present invention is compartmentalized and does not maintain a uniform pressure throughout the whole cushion.

Pearce U.S. Pat. No. 5,829,081 is not filled with air and it does not adjust, unlike the present inventive device. Augustine et al., U.S. Pat. No. 5,800,480, is a mattress. Hand et al., U.S. Pat. No. 5,606,754, utilizes a predetermined pressure all around and is a mattress for a hospital bed, not a wheelchair cushion. Iskra, Jr. et al., U.S. Pat. No. 5,487,197, has "adjoining separate chambers" and maintains an "inflation pressure in the air cushion with an upper and a lower set point." In several embodiments, the present invention does not have adjoining chambers nor does it regulate the inflation pressure between a set upper and lower point. In several embodiments, the present invention uses feedback from sensors to inflate in response to the data gathered. Graebe, Jr. U.S. Pat. No. 5,473,313, is a pump to work with a cushion. Jay, U.S. Pat. No. 5,457,833, is a pad filled with liquid, not air, unlike the present invention, and it arranges around the grooves of the body. In several embodiments, the present invention has bladders and inflates in response to the data gathered from the plurality of sensors. Frantz, U.S. Pat. No. 4,930,171, is a foam cushion with a fluid-filled pad. Jay, U.S. Pat. No. 4,842,330, is a seat cushion that is attached to a body engaging sling that is partially filled with liquid.

Jay, U.S. Pat. No. 4,726,624, is a pad comprising a flexible envelope containing a liquid filling material. Jay, U.S. Pat. No. 4,588,299, is a liquid filling material.

Hall, U.S. Pat. No. 3,987,507, is made up of three pads of resilient foam material assembled on top of the other. Hall uses foam instead of air. EP 0 041 037 has one compartment and has layers of foam on top of it. It is not compartmentalized, unlike several embodiments of the present invention.

Chinese Patent Application 2004/20104890 is a cushion with springs. In several embodiments, the present invention contains bladders to be inflated with air from a gas pump based on pressure sensor readings. The present invention does not have springs.

SUMMARY

In several embodiments, the proposed invention is a wheelchair cushion that would have compartments/divisions that would be individually inflated by air compressors. Another purpose of some embodiments of the present invention is to reduce the risk of bed sores and damage to the body that commonly occurs as a result of excess pressure applied on the skin for long durations of time.

In several embodiments, the present invention would function where one compartment would deflate at a time. The deflated compartment would rotate one at a time scheduled so that each part of the skin receives a release of pressure for a certain period of time, every so often. This would be done by placing small tubes inside the cushion and having them inflate with air compressors, individually. The air would be deflated from the pores on the surface of the cushion.

In several embodiments, the control center of the invention would be an application on a phone, a remote, a dedicated circuit, or a microcontroller. Additional features would include a heat sensor on the surface of the cushion so that the user can monitor on their smartphone which area of the skin is too hot. There would also be an antibacterial mist that would be released with the air to further prevent infection and overheating of the skin. Additionally, there would be a visualization of the pressure values on a device. The last additional feature would be a weight scale included in the cushion so that the user can monitor their day-to-day weight on the chair.

In several embodiments, the present invention is an inflatable cushion comprising; an upper cushion portion; said cushion further comprising side walls, a sectioned perforated top surface; and a hollow interior; a middle cushion portion; said middle portion further comprising middle side walls, a middle perforated top surface and a hollowed interior divided in sections with interior middle dividers; a bottom board; said bottom board further comprising a solid base and three fluid flow tubes; said three fluid flow tubes further comprising each individual fluid flow tube is in mechanical communication with three air containment modules; wherein said upper cushion forms a covering over said middle cushion; and said middle cushion forms a covering over said bottom board wherein each of said air containment modules is housed individually into a section created by said interior middle dividers. In several embodiments, said three fluid flow tubes are attached to a tube with three attachments through openings in said middle side walls and said side walls. In several embodiments, said tube is attached to secondary tube; said secondary tube is attached to an air pump. In several embodiments, said tube is attached to secondary tube; said secondary tube is attached to an air pump and a medication pump. In several embodiments, said air pump is electrically attached to receiver, a battery source and a controller. In several embodiments, said controller is electrically attached to said individual air containment modules, therein controlling the release or activation of each of said modules, said secondary tube is attached to an air pump.

In several embodiments, the present invention is an inflatable cushion comprising; an upper cushion portion; said cushion further comprising side walls, a sectioned perforated top surface; and a hollow interior; a middle cushion portion; said middle portion further comprising middle side walls, a middle perforated top surface and a hollowed interior divided in sections with interior middle dividers; a bottom board; said bottom board further comprising a solid base and three fluid flow tubes; said three fluid flow tubes further comprising each individual fluid flow tube is in mechanical communication with three air containment modules; wherein said upper cushion forms a covering over said middle cushion; and said middle cushion forms a covering over said bottom board wherein each of said air containment modules is housed individually into a section created by said interior middle divider; said three fluid flow tubes are attached to a tube with three attachments through openings in said middle side walls and said side walls; said tube is attached to secondary tube; said secondary tube is attached to an air pump and a medication pump; said air pump is electrically attached to receiver, a battery source and a controller. Said controller is electrically attached to said individual air containment modules therein controlling the release or activation of each of said modules.

In several embodiments, the present invention is a method for inflating a cushion comprising the steps of; providing an inflatable cushion with an, upper cushion portion; said cushion further comprising side walls, a sectioned perforated top surface; and a hollow interior; a middle cushion portion; said middle portion further comprising middle side walls, a middle perforated top surface and a hollowed interior divided in sections with interior middle dividers; a bottom board; said bottom board further comprising a solid base and three fluid flow tubes; said three fluid flow tubes further comprising each individual fluid flow tube is in mechanical communication with three air containment modules; wherein said upper cushion forms a covering over said middle cushion; and said middle cushion forms a covering over said bottom board, wherein each of said air containment modules is housed individually into a section created by said interior middle dividers; said three fluid flow tubes are attached to a tube with three attachments through openings in said middle side walls and said side walls; said tube is attached to secondary tube; said secondary tube is attached to an air pump and a medication pump; said air pump is electrically attached to receiver, a battery source and a controller; said controller is electrically attached to said individual air containment modules, therein controlling the release or activation of each of said modules; sending a signal from said controller to said air pump to pump air into said secondary tube; sending a signal from said controller to one of said individual air containment modules to either open or release air from said module. In several embodiments, there is the additional step of sending a signal from said controller to said medication pump to release medication into said secondary tube.

In several embodiments, the present invention has a covering, a top layer and a hollow layer. In several embodiments, the hollow layer contains a plurality of pods and a plurality of tubes. In several embodiments, the tubes are connected in fluid communication to each pod. In several embodiments, each tube is connected to a pump and a blow-off valve by way of a regulatable two-way valve. In several embodiments, each pod has a pressure sensor associated with it in order to sense pressure in the pod. In several embodiments, the pod is connected to the sensor by way of a tube. In several embodiments, the sensor is then connected to a controller (microcontroller) by way of a wire.

In several embodiments, the present invention can have a pump. In several embodiments, the pump is connected to valves that can be, but are not limited to, two-way valves and/or blow-off valves. In several embodiments, at least one wire connects a battery to 1) each two-way valve and/or each blow-off valve; 2) a microcontroller; 3) the pump. In several embodiments, the microcontroller connects to 1) each blow-off valve or each two-way valve; 2) each sensor; 3) the pump; 4) the microcontroller; and 5) the battery.

In several embodiments, the present invention is an inflatable cushion comprising; a covering; a top layer; a pump; a hollow layer comprising; a plurality of pods with sensors; and a plurality of tubes; a plurality of valves including at least one two-way valve and at least one blow-off valve; wire; a battery; and a microcontroller; wherein said wire connects said battery to: each two-way valve, each blow-off valve, and said microcontroller; said microcontroller connects to: each blow-off valve, each two-way valve, each sensor, said battery and said pump; said plurality of tubes are connected to each individual pod, and each tube is connected to said pump and said individual blow-off valve by way of said two-way valve; said each pod has a pressure sensor to sense pressure in said pod; and said pod is connected to said sensor by way of an individual tube, and said sensor is also connected to said microcontroller by way of said wire.

In several embodiments, the present invention is an inflatable cushion comprising; an upper cushion portion; said cushion further comprising side walls and a hollow interior; a middle cushion portion; said middle portion further comprising middle side walls; a bottom board; said bottom board further comprising a solid base, fluid pods with fluid valves and multiple fluid flow tubes; fluid flow tubes further comprising each individual fluid flow tube is in mechanical communication with said fluid valves, wherein said upper cushion forms a covering over said middle cushion; and said middle cushion forms a covering over said bottom board, wherein each of said fluid pods is spaced on said bottom board.

In several embodiments, the present invention is an inflatable cushion comprising; a cover; a base; a top layer; a communication device; a microcontroller; a power source; a gas pump; a primary tube; a blow off valve; two-way valves; a plurality of secondary tubes; a plurality of pressure sensors; and a plurality of bladder pods; wherein said plurality of bladders pods are on said base; said plurality of bladder pods are in individual fluid communication with said individual secondary tubes; said individual secondary tubes are in fluid communication with said individual pressure sensors; said individual secondary tubes are in further fluid communication with said individual two-way valves; said two-way valves are in fluid communication with said primary tube; said primary tube is in fluid communication with said gas pump and said blow off valve; said microcontroller can receive and send signals to said blow off valve, said gas pump, said individual two-way valves, said communication device, and/or said individual sensor; said microcontroller is powered by said power source; and said plurality of bladder pods are covered by said cover attaching to said base.

In several embodiments, said power source is a battery. In several embodiments, said microcontroller is a computer system on a chip that does a job. It contains an integrated processor, memory (a small amount of RAM, program memory, or both), and input/output peripherals, which are used to interact with things connected to the chip. In several embodiments, said communication device is a device that has the potential of having wired or wireless interconnection of mobile phones, computers, and other electronic devices. In several embodiments, said plurality of sensors are located between the top layer and base when the cushion is assembled and encased in the cover. In several embodiments, there is a soft layer of padding located beneath said cover.

In several embodiments, the present invention is an inflatable cushion comprising; a cover; a base; a top layer; a communication device; a microcontroller; a power source; a gas pump; a primary tube; a blow off valve; two-way valves; a plurality of secondary tubes; a plurality of bladder pods with pressure sensors; wherein said plurality of bladders pods with pressure sensors are on said base; said plurality of bladder pods with pressure sensors are in individual fluid communication with said individual secondary tubes; said individual secondary tubes are in further fluid communication with said individual two-way valves; said two-way valves are in fluid communication with said primary tube; said primary tube is in fluid communication with said gas pump and said blow off valve; said microcontroller can receive and send signals to said blow off valve, said gas pump, said individual two-way valve, said communication device, and/or said individual bladder pads with pressure sensors; said microcontroller is powered by said power source; and said plurality of bladder pods with pressure sensors are covered by said cover attaching to said base. In several embodiments, said power source is a battery. In several embodiments, said microcontroller is a computer system on a chip that does a job. It contains an integrated processor, memory (a small amount of RAM, program memory, or both), and input/output peripherals, which are used to interact with things connected to the chip. In several embodiments, said communication device is a device that has the potential of having short-range wireless interconnection of mobile phones, computers, and other electronic devices. In several embodiments, said plurality of secondary tubes are located inside the cover and base when the cushion is assembled. In several embodiments, there is a soft layer of padding located underneath said cover.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
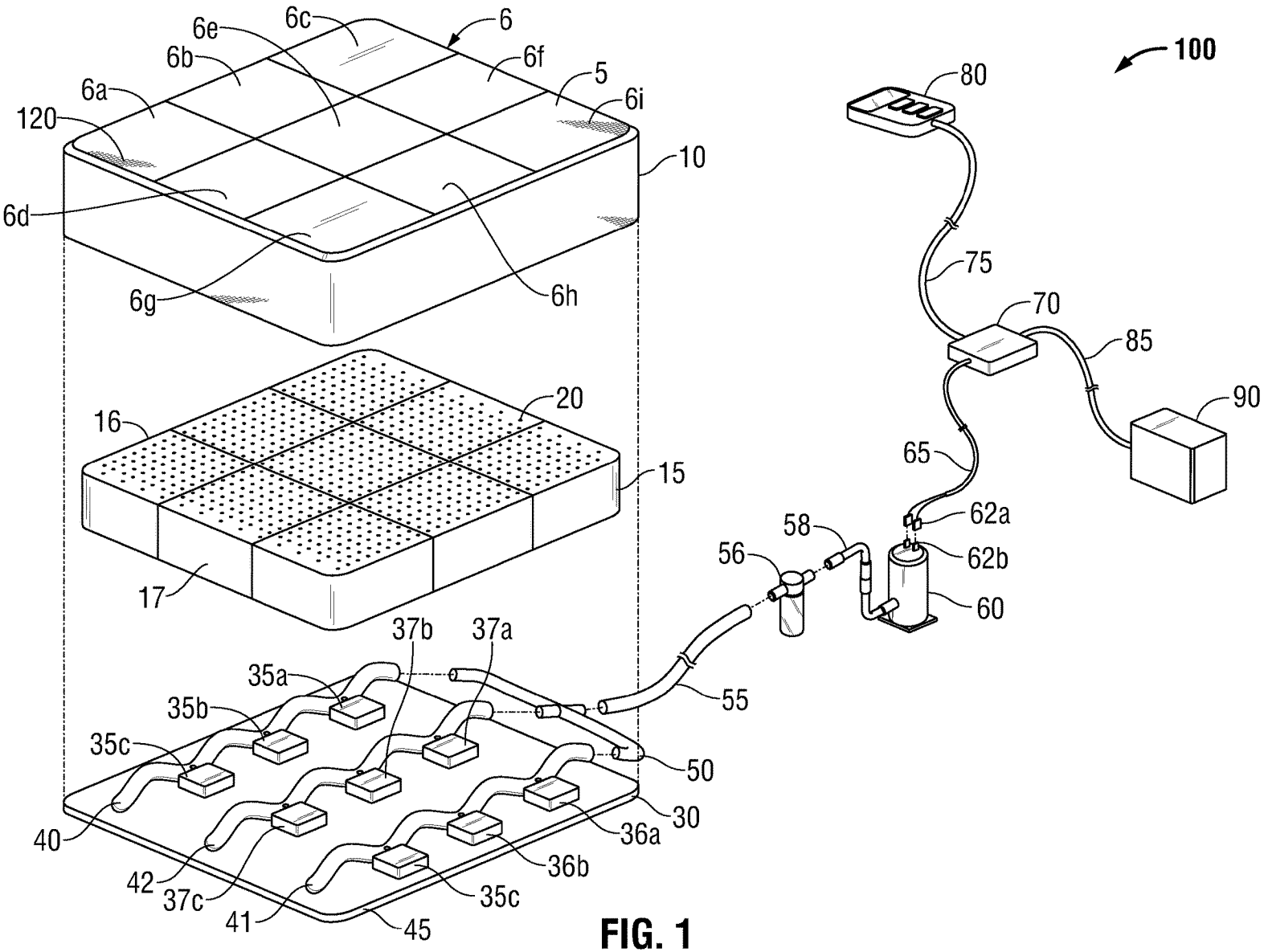
FIG. 1 is an exploded view of one embodiment of the present invention.

One or more illustrative embodiments incorporating the invention disclosed herein are presented below. Applicant has created a revolutionary and novel portable cushion and method of use of the same.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless, or essentially meaningless, the definition should be taken from Webster's Dictionary, 2016. Definitions and/or interpretations should not be incorporated from other patent applications, patents, or publications, related or not, unless specifically stated in this specification, or if the incorporation is necessary for maintaining validity.

Certain terms are used in the following description and claims to refer to particular system components. As one skilled in the art will appreciate, different persons may refer to a component by different names. This document does not intend to distinguish between components that differ in name but not function. The drawing figures are not necessarily to scale. Certain features of the invention may be shown exaggerated in scale or in somewhat schematic form, and some details of conventional elements may not be shown, all in the interest of clarity and conciseness. "Microcontroller", as defined herein, can be a computer system on a chip that does a job. A microcontroller can contain an integrated processor, memory (a small amount of RAM, program memory, or both), and input/output peripherals, which are used to interact with things connected to the chip.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

FIG. 1 shows one embodiment of the present invention in an exploded form. The present inventive cushion 100 is illustrated. As shown, the cushion's horizontal surface 5 is preferably designed to be semi-pliable but formed to hold the shape of substantially an outer edge wall. Horizontal surface 5 can be comprised of a plurality of materials both natural and synthetic. Horizontal surface 5 forms the upper face of the cushion upper cover 6. As shown in some embodiments, upper cover 6 is defined by vertical walls 10 and horizontal surface 5.

As shown, inner cushion 15 is preferably designed to be a hollow frame with a top surface 16 and side wall edge 17. Inner cushion 15 is designed to comfortably and pliably support a user. The upper top surface 16 is preferably constructed with perforations or pores 20 designed for the egress of air and gas exiting the cushion compartments.

Further shown is the bottom board 30 of one embodiment of the present invention. As shown, three gas tubes 40, 41, 42 are preferably arranged in parallel such that the ends of the tubes exit off of the bottom board 30 and may attach to the air tube 50. As shown, air containment modules 35*a*, 35*b*, and 35*c* are attached to tube 40 and designed to hold the air in compartments without spreading, with the goal being to keep air in the varying compartment combinations. As shown, air containment modules 36*a*, 36*b*, and 36*c* are attached to tube 41 and designed to hold the air in the appropriate compartment. As shown, air containment modules 37*a*, 37*b*, and 37*c* are attached to tube 42 and designed to hold the air in the appropriate compartment. The vertical edge 45 of inventive cushion 100 is preferably designed to support the weight of a user.

As shown, air tube 50 separates into two different passages to attach to tubes 40 and 41 in the cushion. Likewise, tube 50 attaches to air tube 55 designed to move air towards the cushion for distribution while in use. Further shown, compartment 56 can carry medication inside of it and humidify it into the air that will flow into tube 55. Pipe 58 connects the air pump 60 to the medication container, or compartment 56. Air pump 60 is an air pump/air compressor as is known in the industry. 62*a* and 62*b* are electrical wires from the battery, indicated by 90 on the drawings, to power the air pump 60. Electrical wire 65 is covered in a sheath to protect it in the manner normally known in the art.

Receiver 70 is also attached to the air pump 60. The purpose of the receiver is to receive the signal from the remote and convert the signal to instructions to the pump. Wire 75 connects the remote control 80 to the receiver 70. Wire 85 connects the receiver 70 to the battery 90.

Figure 2:
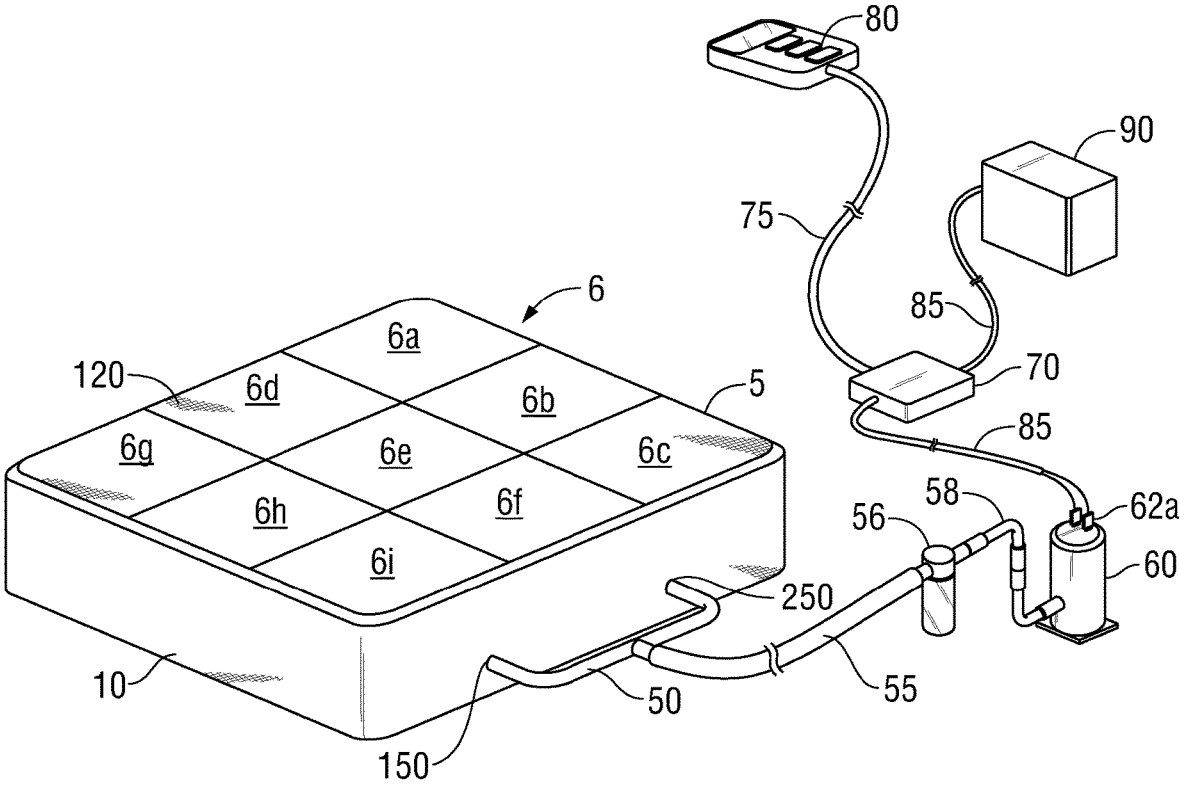
FIG. 2 is an assembled side view of one embodiment of the present invention.

FIG. 2 illustrates one embodiment of the present invention in assembled form. As shown, upper cover 6 is mechanically placed over inner cushion 15 and attached to bottom board 30 (FIG. 1). In many embodiments, these three elements are attached as a single functional unit. Further shown are the two connection ports 150 and 250 on the exterior of one side of the connection between the tube 50 and the cushion wall 10. Subsections 6*a*-6*i* are the sections of cushion upper cover 6 which have varying air mists pushed through the perforations located on the surface of the cushion mesh cover 120.

Figure 3:
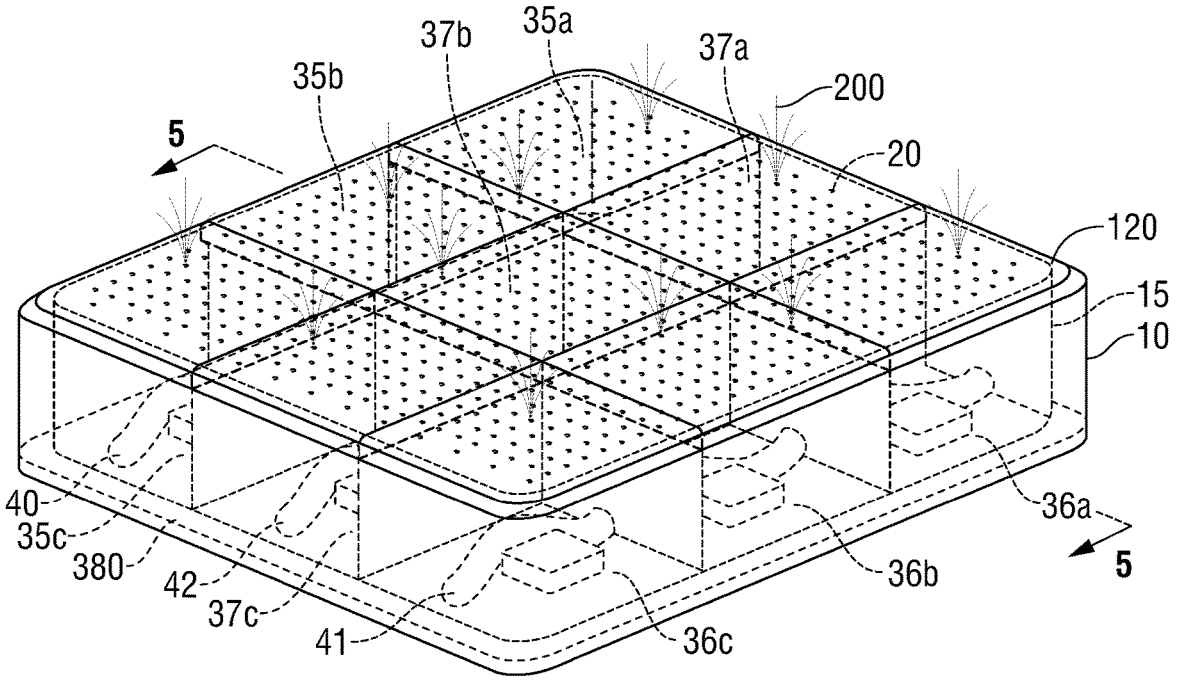
FIG. 3 is an assembled side view of one embodiment of the present invention in partial transparency.
Figure 4:
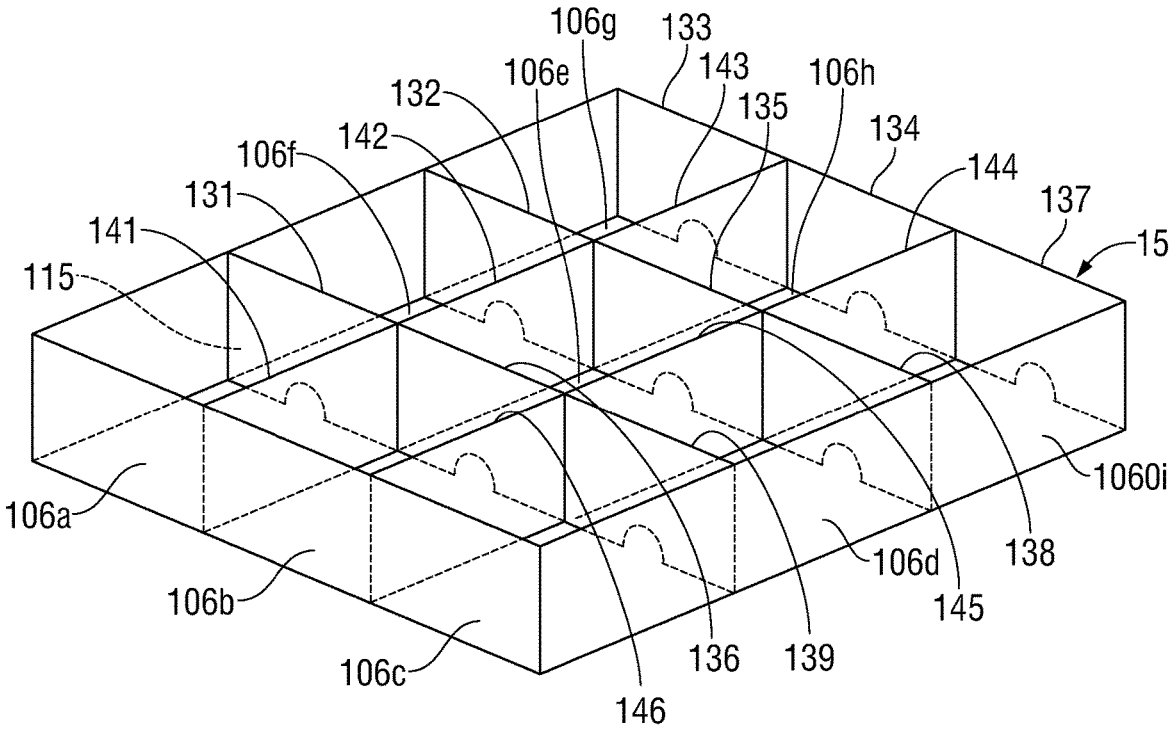
FIG. 4 is an assembled side view of one embodiment of the present invention in partial transparency of the lower sections of the cushion.

FIG. 3 illustrates one embodiment of the present invention in partial transparency. Medicated air 200 is being released from the pores 20 on the inner cushion 15 and then through the perforations on subsections 6*a*-*i* on the cushion upper cover 6. FIG. 4 shows the additional divider walls 131, 132, 133, 134, 135, 136, 137, 138 and 139, which have orifices designed to have the tubes 40, 41, and 42 pass through them in a tight seal such that air cannot escape between divided sections. The sections 106*a-i* are further defined by dividing walls 141, 142, 143, 144, 145, and 146 which are substantially in airtight seal with the corresponding adjacent walls. In each section 106*a-i* there is an air containment module that is in electronic communication with controller 80. During operation is it envisioned that individual controllers can be activated individually to allow air to flow into each individual subsection 106*a-i*. Further drawings of the sections 106*a-i* are included in FIG. 4.

FIG. 4 illustrates one embodiment of the interior frame 115 shown inner cushion 15 is preferable designed to be a hollow frame 115 with a top surface 16 and side wall edge 17 (FIG. 1). Inner cushion 15 is designed to comfortably and pliably support a user. The upper top surface 16 is preferably constructed with perforations or pores 20 designed for the egress of air and gas exiting the cushion compartments. FIG. 4 shows the additional divider walls 131, 132, 133, 134, 135, 136, 137, 138 and 139, which have orifices designed to have the tubes 40, 41, and 42 pass through them in a tight seal such that air cannot escape between divided sections. The sections 106*a-i* are further defined by dividing walls 141, 142, 143, 144, 145, and 146, which are substantially in airtight seal with the corresponding adjacent walls. In each section 106*a-i* there is an air containment module that is in electronic communication with remote control 80. During operation it is envisioned that individual controllers can be activated individually to allow air to flow into each individual subsection 106*a-i*. Further drawings of the sections 106*a-i* are included in FIG. 4.

Figure 5:
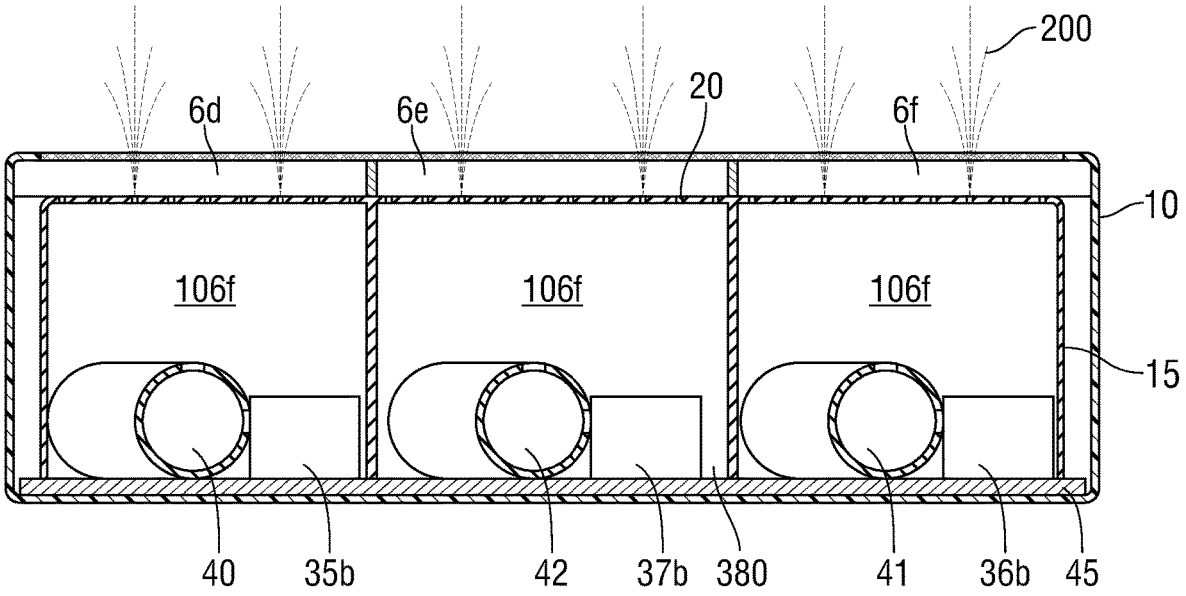
FIG. 5 is a partial side cross sectional view of one embodiment.

FIG. 5 illustrates a partial cross-sectional side view of one embodiment of the present invention. As shown, tube 41 is attached to air containment module 36*a, b*, and *c* through port 43. Tube 41 is attached to inner cushion 15 through port 47. The ports 47 and 48 are left open for the air to openly flow from the tubes to the cushion 15. Ports 42 and 43 are controlled by 35*b* and 36*b*. When allowed by 35*b* and 36*b*, air will flow into the tubes 41 and 40. As shown, tube 40 is attached to air containment module 35*a* through port 42. Tube 40 is attached to inner cushion 15 through port 48. Also shown is the empty air vacuum space between the two tubes (40, 41).

Figure 6:
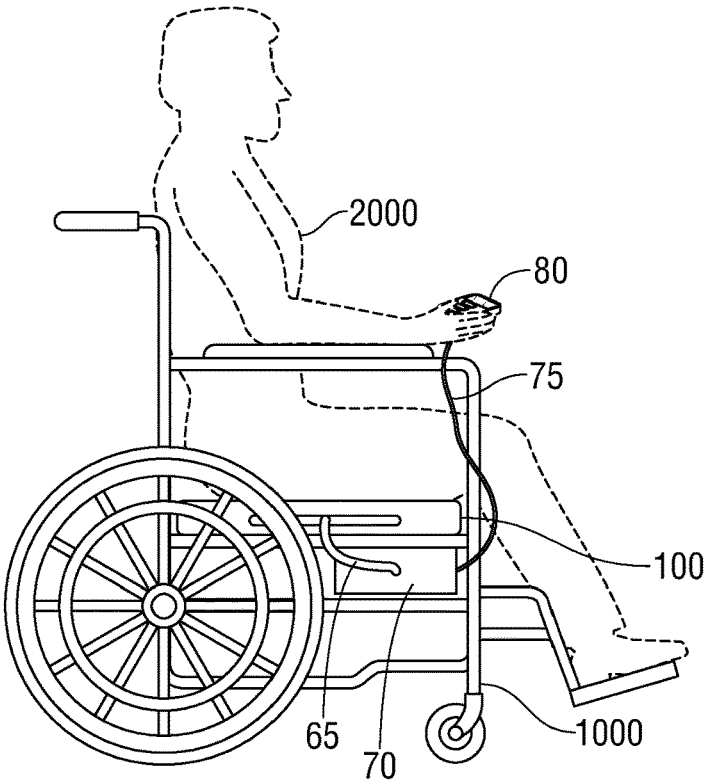
FIG. 6 is a view of a user sitting on the device in a deflated mode.

FIG. 6 illustrates one embodiment of the present invention with a user 2000 sitting on the inventive cushion 100. As shown, the user 2000 is sitting in a wheelchair 1000, which is a wheelchair as known commonly in the art. A wheelchair provides the user the ability to be mobile. It can be either manually powered or automated, and in this case, it is manually powered. The user 2000 is holding remote control 80 and the remote control 80 is attached to receiver 70, as is earlier described. Inventive cushion 100 is in a deflated mode in this illustration.

Figure 7:
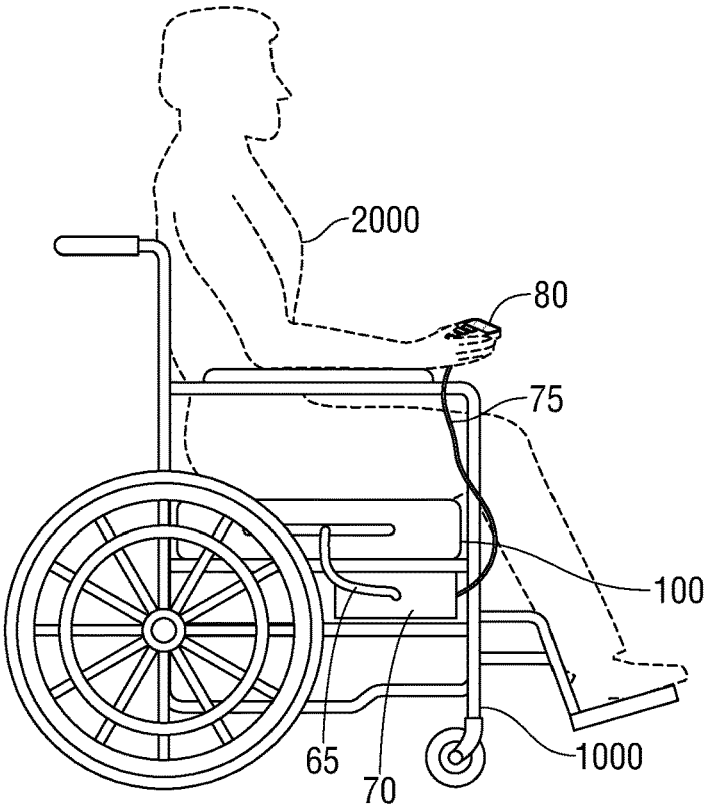
FIG. 7 is a view of a user sitting on the device in an inflated mode.

FIG. 7 illustrates one embodiment of the present invention in which the cushion 100 is inflated with air to the highest capacity. That is why the individual (2000) is elevated in contrast to FIG. 5. These two figures were included to show the variance of the cushion's inflation levels.

Figure 8:
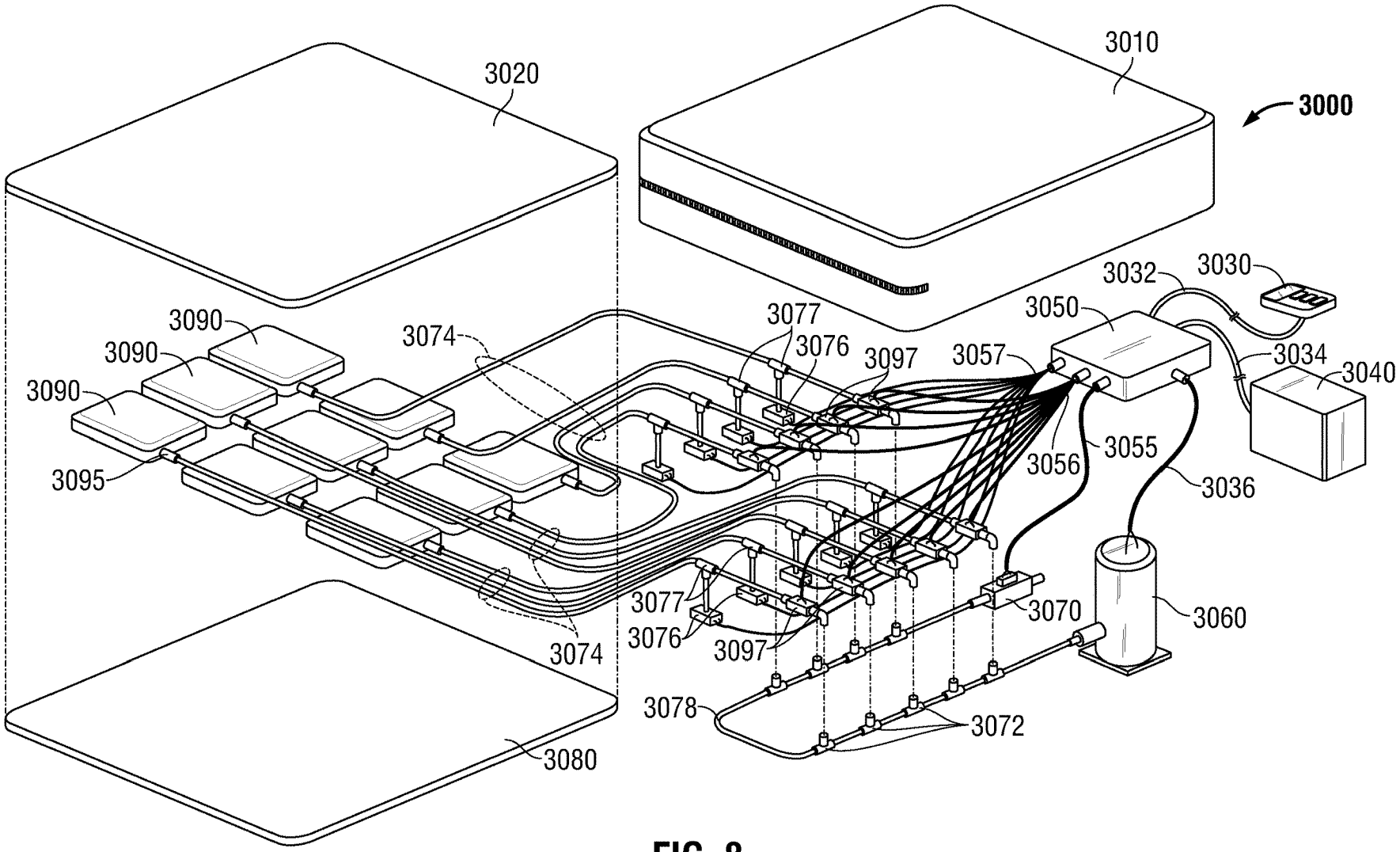
FIG. 8 is an exploded view of one embodiment of the present invention.

FIG. 8 shows one embodiment of the present invention 3000 in an exploded form. As shown, is one embodiment of the present inventive cushion system. As shown, in some embodiments, cushion cover 3010 is designed to encapsulate the internal elements of the present invention. The internal elements encapsulated by the cushion cover 3010 are: a plurality of bladder pods 3090 and the connections for said bladder pods 3095. As shown, cushion cover 3010, in several embodiments, can be composed of a soft material known in the art for seat cover materials. Further illustrated, in several embodiments, is the top layer of padding 3020, which is designed in several embodiments to add a cushion layer between the cushion cover 3010 and more inner elements of the present invention. In several embodiments, top layer of padding can be composed of one or more types of foam.

FIG. 8 also illustrates a communication device 3030 that can be connected to the microcontroller 3050 in many embodiments. The communication device 3030's primary functions are to provide user feedback to the microcontroller 3050 and display visualizations of sensor data and can be a phone, a remote, or similar operational device. As shown in many embodiments, the communication device 3030 can be connected to the microcontroller 3050 through a wire, or remote signal mechanism 3032. In several embodiments, remote signal mechanism 3032 can be a physical wire connection or a remote signal such as Bluetooth or Wi-Fi.

In several embodiments of the present invention, microcontroller 3050 is designed to take inputs from the plurality of pressure sensors 3076, and in combination with optional user feedback from the communication device 3030, algorithmically modulates the pressure volume in the plurality of bladder pods 3090 by alternating the activation of the plurality of two-way valves 3097, blow-off valve 3070, and air pump 3060. In several embodiments of the present invention, microcontroller 3050 connects with an energy source, or battery 3040 through wire 3034. In several embodiments, the battery 3040 can be any power source capable of powering microcontroller 3050, the plurality of two-way valves 3097, blow-off valve 3070, air pump 3060, and the plurality of pressure sensors 3076.

In several embodiments of the present invention, microcontroller 3050 connects to air pump, or gas pump, 3060 via wire 3036 in a manner for connections from a microcontroller 3050 to a pump 3060. In several embodiments of the present invention, air pump 3060 is designed to pump air into main tube 3078 such that said air can eventually fill one of several bladder pods 3090. In several embodiments, microcontroller 3050 is also in electronic communication with blow off valve 3070, which is attached at the end of the main tube 3078. The connection between controller 3050 and blow off valve 3070 is preferably such that blow off valve 3070 can be activated or deactivated to bleed off air based upon instructions relayed by controller 3050.

In several embodiments, further located, and in communication with main tube 3078 are connections 3072. In several embodiments, connections 3072 are designed to connect with two-way valves 3097, such that air can flow through said connections 3072 and two-way valves 3097.

In several embodiments, connected to the two-way valves 3097 are props 3077 and sensors 3076 via individual bladder, or secondary tubes 3074. In several embodiments, sensors 3076 are designed to sense air pressure that will be in the bladder pods 3090. In several embodiments, the sensors 3076 are linked and in communication with microcontroller 3050 through wires 3057.

In several embodiments, the wires 3056 and 3057 connecting the microcontroller 3050 to the two-way valves 3097 and the sensors 3076, respectively, are dual connection wires containing both data and power from the microcontroller 3050 and the battery 3040. In several embodiments, the wires 3055 and 3036 connecting the microcontroller 3050 to the blow-off valve 3070 and air pump 3060, respectively, are dual connection wires containing both data and power from the microcontroller 3050 and the battery 3040.

In several embodiments of the present invention, individual air bladder tubes 3074 connect with bladder pods 3090. In several embodiments, bladder pods 3090 can fill or deflate depending on the opening and closing of two-way valve 3097 which is controlled by the microcontroller 3050. This decision is made in coordination with the opening and closing of blow-off valve 3070 and pump 3060, resulting in air being forced or released though bladder tubes 3074. Also illustrated, in several embodiments, base 3080 forms the bottom upon which the bladder pods 3090 can rest.

In several embodiments, the present invention is an inflatable cushion 3000 comprising; a cover 3010; a top layer 3020; a base 3080; a communication device 3030; a microcontroller 3050; a power source 3040; a gas pump 3060; a primary tube 3078; a blow off valve 3070; two-way valves 3097; a plurality of secondary tubes 3074; a plurality of pressure sensors 3076; and a plurality of bladder pods 3090; wherein said plurality of bladder pods 3090 are on said base 3080; said plurality of bladder pods 3090 are in individual fluid communication with said individual secondary tubes 3074; said individual secondary tubes 3074 are in fluid communication with said individual pressure sensors 3076; said individual secondary tubes 3074 are in further fluid communication with said individual two-way valves 3097; said two-way valves 3097 are in fluid communication with said primary tube 3078; said primary tube 3078 is in fluid communication with said gas pump 3060 and said blow off valve 3070; said microcontroller 3050 can receive and send signals to said blow off valve 3070, said gas pump 3060, said individual two-way valves 3097, said communication device 3030, and/or said individual sensor 3076; said microcontroller 3050 is powered by said power source 3040; and said plurality of bladder pods 3090 are covered by said top layer 3020 attaching to said base 3080, and all encased by said cover 3010. In several embodiments, said power source 3040 is a battery. In several embodiments, said microcontroller 3050 is a computer system on a chip that does a job. It contains an integrated processor, memory (a small amount of RAM, program memory, or both), and input/output peripherals, which are used to interact with things connected to the chip. In several embodiments, said communication device 3030 is a device that has the potential of having wired or wireless interconnection of mobile phones, computers, and other electronic devices. In several embodiments, said plurality of sensors 3076 are located inside the cover 3010 and base 3080 when the cushion 3000 is assembled. In several embodiments, there is a soft layer of padding 3020 located beneath said cover 3010. In several embodiments gas pump 3060 can pump air.

In several embodiments, the user starts off by resting on the device. The device's embedded sensors detect the pressure levels, in real-time, and send that data via a wire to the microcontroller. The microcontroller determines, bases on an algorithm, which bladders are to be inflated/deflated, according to the data retrieved from the plurality of pressure sensors. A signal will be carried via wires to the two-way valves to allow the air to escape from the bladders that are to be deflated. The air will travel, via fluid tube, through the two-way valve and through the blow-off valve. The two-way valves of the bladders that are to be inflated will allow air to flow from the gas pump into the bladders. Simultaneously, the microcontroller will be sending the pressure readings from the plurality of sensors to the communication device. This allows the user to have an interface of the areas of high/low pressure.

Figure 9:
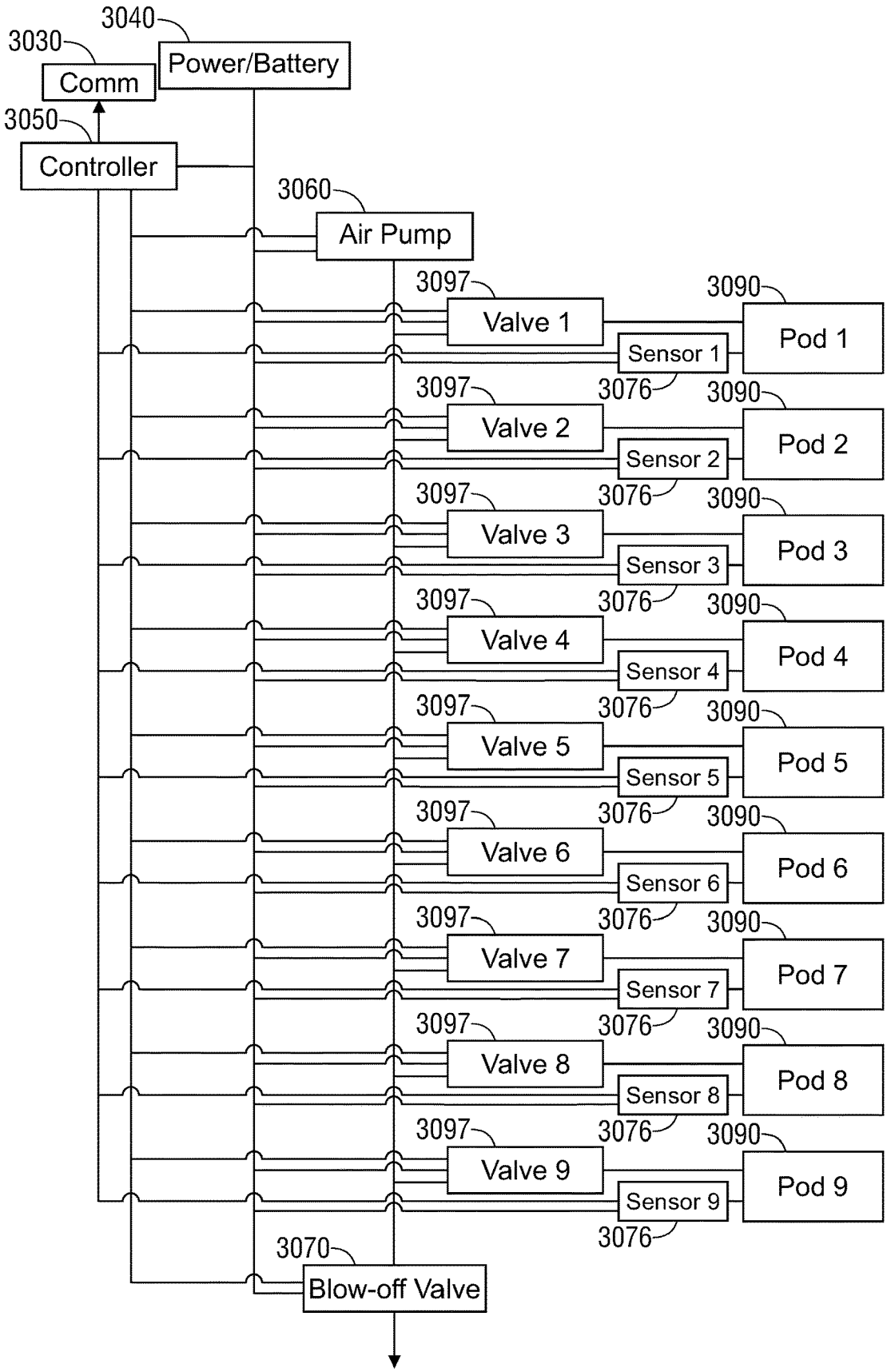
FIG. 9 is a schematic view of one embodiment of the present invention.

FIG. 9 illustrates one embodiment of the present invention in schematic form. As shown, in several embodiments, the microcontroller 3050 connects to the communication device 3030 wirelessly, or over a wire, in order to transmit data and to receive optional user feedback. In several embodiments, the battery 3040 is also attached to the controller and air pump 3060 in order to power these elements of the present invention. In several embodiments, the controller 3050 and air pump are in fluid communication with a number of valves 3097 and bladder pods 3090 such that air pressure information and air flow is regulated via the controller 3050 and the air pump 3060 through the regulation of air flow. In several embodiments, controller 3050 is in direct communication with a variety of pressure sensors 3076, which are sensing the pressures in the individual bladder pods 3090. In several embodiments, controller 3050 is also in direct communication with blow-off valve 3070 to release air in the system.

Figure 10:
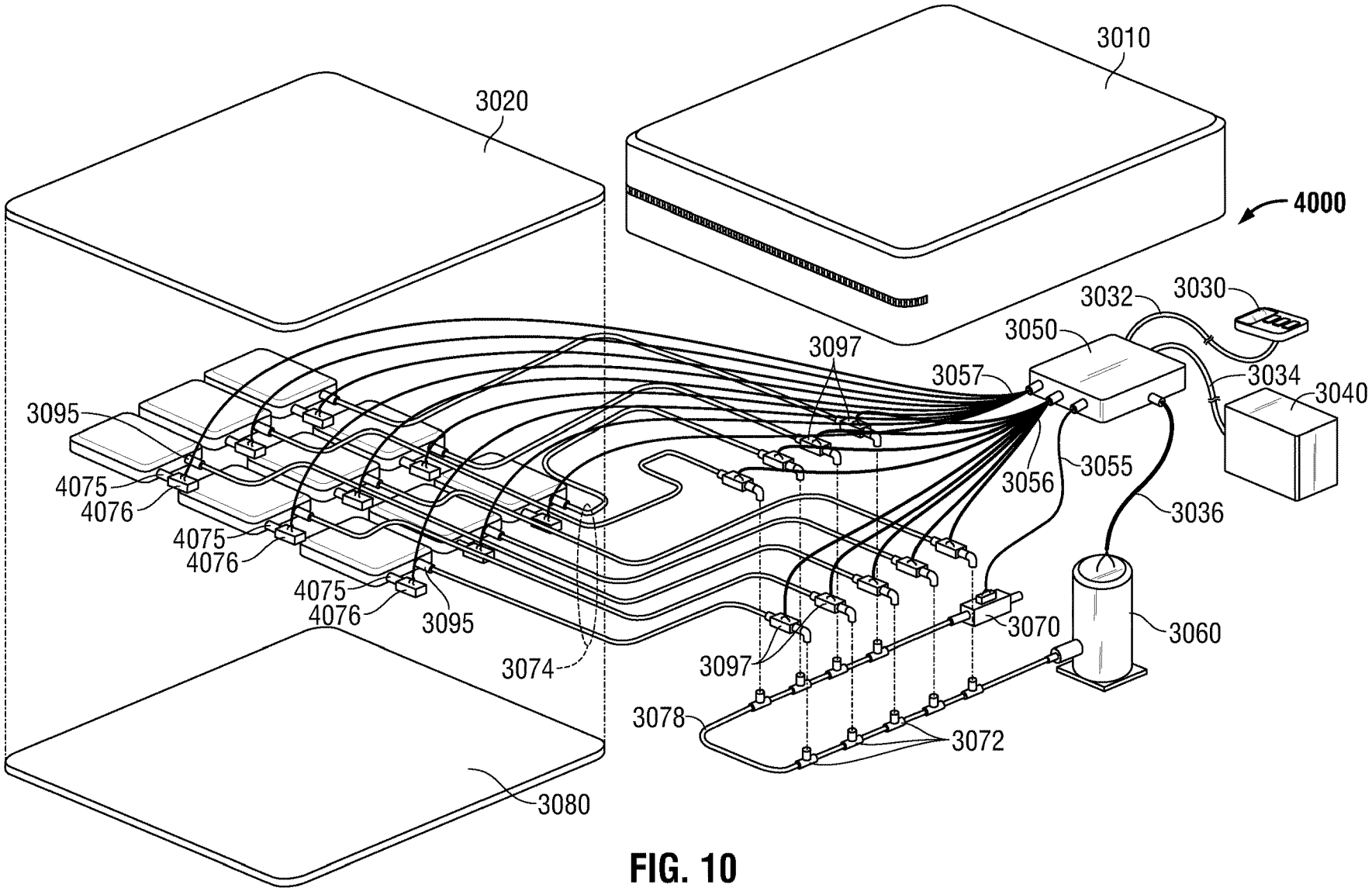
FIG. 10 is an exploded view of one embodiment of the present invention.

FIG. 10 illustrates one embodiment of the present invention 4000 in exploded form. As shown is one embodiment of the present inventive cushion system. As shown, in some embodiments, cushion cover 3010 is designed to encapsulate the internal elements of the present invention. The internal elements encapsulated by the cushion cover 3010 are: a plurality of bladder pods 3090, the connections for said bladder pods 3095, and a plurality of pressure sensors 4076. As shown, cushion cover 3010, in several embodiments, can be composed of a soft material known in the art for seat cover materials. Further illustrated, in several embodiments, is the top layer of padding 3020, which is designed in several embodiments to add a cushion layer between the cushion cover 3010 and more inner elements of the present invention. In several embodiments, the top layer of padding can be composed of one or more types of foam.

FIG. 10 also illustrates a communication device 3030 that can be connected to the microcontroller 3050 in many embodiments. The communication device 3030's primary function is to provide user feedback to the microcontroller 3050 and display visualizations of sensor data and can be a phone, a remote, or similar operational device. As shown in many embodiments, the communication device 3030 can be connected to the microcontroller 3050 through a wire, or remote signal mechanism 3032. In several embodiments, remote signal mechanism 3032 can be a physical wire connection or a remote signal such as Bluetooth or Wi-Fi.

In several embodiments of the present invention, microcontroller 3050 is designed to take inputs from the plurality of pressure sensors 4076 and in combination with optional user feedback from the communication device 3030, algorithmically modulates the pressure volume in the plurality of bladder pods 3090 by alternating the activation of the plurality of two-way valves 3097, blow-off valve 3070, and air pump 3060. In several embodiments of the present invention, microcontroller 3050 connects with an energy source, or battery 3040, through wire 3034. In several embodiments, the battery 3040 can be any power source capable of powering microcontroller 3050, the plurality of two-way valves 3097, blow-off valve 3070, air pump 3060, and the plurality of sensors 4076.

In several embodiments of the present invention, microcontroller 3050 connects to air pump 3060 via wire 3036 and in a manner for connections for a microcontroller 3050 to a pump 3060. In several embodiments of the present invention, air pump 3060 is designed to pump air into main, or primary, tube 3078 such that said air can eventually fill one of several bladder pods 3090. In several embodiments, microcontroller 3050 is also in electronic communication with blow off valve 3070, which is attached at the end of the main tube 3078. The connection between controller 3050 and blow off valve 3070 is preferably such that blow off valve 3070 can be activated or deactivated to bleed off air based upon instructions relayed by controller 3050.

In several embodiments, further located, and in communication with main tube 3078, are connections 3072. In several embodiments, connections 3072 are designed to connect with two-way valves 3097, such that air can flow through said connections 3072 and two-way valves 3097.

In several embodiments, connected to the two-way valves 3097 are sensors 4076 attached via a fluid tube 4075 to bladder pods 3090. In several embodiments, air can enter bladder pods 3090 via individual bladder tubes 3074. In several embodiments, sensors 4076 are designed to sense air pressure that will be in the bladder pods 3090. In several embodiments, the sensors 4076 are linked and in communication with microcontroller 3050 through wires 3057.

In several embodiments, the wires 3056 and 3057 connecting the microcontroller 3050 to the two-way valves 3097 and the sensors 4076, respectively, are dual connection wires containing both data and power from the microcontroller 3050 and the battery 3040. In several embodiments, the wires 3055 and 3036 connecting the microcontroller 3050 to the blow-off valve 3070 and air pump 3060, respectively, are dual connection wires containing both data and power from the microcontroller 3050 and the battery 3040.

In several embodiments of the present invention, individual air bladder tubes 3074 connect with bladder pods 3090. In several embodiments, bladder pods 3090 can fill or deflate depending on the opening and closing of two-way valves 3097, which are controlled by the microcontroller 3050. This decision is made in coordination with the opening and closing of blow-off valve 3070 and pump 3060, resulting in air being forced or released from them flowing though bladder tubes 3074. Also illustrated, in several embodiments, base 3080 forms the bottom upon which the bladder pods 3090 can rest.

In several embodiments of the present invention, the present invention is an inflatable cushion 4000 comprising; a cover 3010; a base 3080; a communication device 3030; a microcontroller 3050; a power source 3040; a gas pump 3060; a primary tube 3078; a blow off valve 3070; two-way valves 3097; a plurality of secondary tubes 3074; a plurality of bladder pods with pressure sensors; wherein said plurality of bladders pods 3090 with pressure sensors 4076 are on said base 3080; said plurality of bladder pods 3090 with pressure sensors 4076 are in individual fluid communication with said individual secondary tubes 3074; said individual secondary tubes 3074 are in further fluid communication with said individual two-way valves 3097; said two-way valves 3097 are in fluid communication with said primary tube 3078; said primary tube 3078 is in fluid communication with said gas pump 3060 and said blow off valve 3070; said microcontroller 3050 can receive and send signals to said blow off valve 3070, said gas pump 3060, said individual two-way valve 3097, said communication device 3030, and/or said individual bladder pads 3090 with pressure sensors 4076; said microcontroller 3050 is powered by said power source 3040; and said plurality of bladder pods 3090 with pressure sensors 4076 are covered by said cover 3010 attaching to said base 3080. In several embodiments, said power source 3040 is a battery. In several embodiments, said microcontroller 3050 is a computer system on a chip that does a job. It contains an integrated processor, memory (a small amount of RAM, program memory, or both), and input/output peripherals, which are used to interact with things connected to the chip. In several embodiments, said communication device 3030 is a device that has the potential of having wired or wireless interconnection of mobile phones, computers, and other electronic devices. In several embodiments, said plurality of secondary tubes 3074 are located inside the cover 3010 and base 3080 when the cushion 4000 is assembled. In several embodiments, there is a top layer of padding 3020 under the cover 3010.

In several embodiments, the user starts off by resting on the device. The device's embedded sensors detect the pressure levels, in real-time, and send that data via a wire to the microcontroller. The microcontroller determines, based on an algorithm, which bladders are to be inflated/deflated, according to the data retrieved from the plurality of pressure sensors. A signal will be carried via wires to the two-way valves to allow the air to escape from the bladders that are to be deflated. The air will travel, via fluid tube, through the two-way valve and through the blow-off valve. The two-way valves of the bladders that are to be inflated will allow air to flow from the gas pump into the bladders. Simultaneously, the microcontroller will be sending the pressure readings from the plurality of sensors to the communication device. This allows the user to have an interface of the areas of high/low pressure.

While preferred embodiments have been shown, and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied. Accordingly, it is intended that the following claims be interpreted to embrace all such variations and modifications.

We claim:

1. An inflatable cushion with non-uniform pressure comprising;

a cover;
a top layer;
a base;
a communication device;
a microcontroller;
a portable power source;
a gas pump;
a primary tube;
a blow off valve;
a plurality of two-way valves;
a plurality of secondary tubes;
a plurality of pressure sensors; and
a plurality of bladder pods; wherein
- said pressure sensors are designed to sense air pressure in said bladder pods;
- said plurality of bladders pods are on said base;
- said plurality of bladder pods are below said top layer;
- said plurality of bladder pods are in individual fluid communication with said individual secondary tubes;
- said individual secondary tubes are in fluid communication with said individual pressure sensors;
- said individual secondary tubes are in further fluid communication with said individual two-way valves;
- said two-way valves are in fluid communication with said primary tube;
- said primary tube is in fluid communication with said gas pump and said blow off valve;

said microcontroller can receive and send signals to said blow off valve, said gas pump, said individual two-way valves, said communication device, and/or said individual pressure sensors;

said microcontroller, said gas pump, said blow off valve, said plurality of two-way valves, and said plurality of pressure sensors are all powered by said portable power source; and said plurality of bladder pods are covered by said cover attaching to said base.

2. The inflatable cushion of claim 1 further comprising: said portable power source is a battery.

3. The inflatable cushion of claim 1 further comprising: said microcontroller is a computer system on a chip that contains an integrated processor, memory (a small amount of RAM, program memory, or both), and input/output peripherals, which are used to interact with said two way valves, said blow-off valve, said communication device, and/or said portable power source.

4. The inflatable cushion of claim 1 further comprising: said communication device is a device that has the potential of having wired or wireless interconnection of mobile phones, computers, and other electronic devices.

5. The inflatable cushion of claim 1 further comprising: said plurality of sensors are located inside the cover and base when the cushion is assembled.

6. The inflatable cushion of claim 1 further comprising: a soft layer of padding underneath said cover.

7. An inflatable cushion with non-uniform pressure comprising;

a cover;

a base;

a top layer;

a communication device;

a microcontroller;

a portable power source;

a gas pump;

a primary tube;

a blow off valve;

a plurality of two-way valves;

a plurality of secondary tubes;

a plurality of bladder pods with pressure sensors; wherein said pressure sensors are designed to sense air pressure in said bladder pods;

said plurality of bladders pods with pressure sensors are on said base;

said plurality of bladder pods are below said top layer;

said plurality of bladder pods with pressure sensors are in individual fluid communication with said individual secondary tubes;

said individual secondary tubes are in further fluid communication with said individual two-way valves;

said two-way valves are in fluid communication with said primary tube;

said primary tube is in fluid communication with said gas pump and said blow off valve;

said microcontroller can receive and send signals to said blow off valve, said gas pump, said individual two-way valves, said communication device, and/or said individual bladder pads with pressure sensors;

said microcontroller, said gas pump, said blow off valve, said plurality of two-way valves, and said plurality of pressure sensors are all powered by said portable power source; and said plurality of bladder pods with pressure sensors are covered by said cover attaching to said base.

8. The inflatable cushion of claim 7 further comprising: said portable power source is a battery.

9. The inflatable cushion of claim 7 further comprising: said microcontroller is a computer system on a chip that contains an integrated processor, memory (a small amount of RAM, program memory, or both), and input/output peripherals, which are used to interact with said two way valves, said blow-off valve, said communication device, and/or said portable power source.

10. The inflatable cushion of claim 7 further comprising: said communication device is a device that has the potential of having wired or wireless interconnection of mobile phones, computers, and other electronic devices.

11. The inflatable cushion of claim 7 further comprising: said secondary tubes are located inside the cover and base when the cushion is assembled.

12. The inflatable cushion of claim 7 further comprising: a soft layer of padding underneath said cover.

13. An inflatable cushion with non-uniform pressure comprising;

a cover;

wherein there is a soft layer of padding attached beneath said cover;

a base;

a top layer;

a communication device;

a microcontroller;

a portable power source;

a gas pump;

a primary tube;

a blow off valve;

a plurality of two-way valves;

a plurality of secondary tubes;

a plurality of pressure sensors; and a plurality of bladder pods; wherein said pressure sensors are designed to sense air pressure in said bladder pods;

said plurality of bladders pods are on said base;

said plurality of bladder pods are below said top layer;

said plurality of bladder pods are in individual fluid communication with said individual secondary tubes;

said individual secondary tubes are in fluid communication with said individual pressure sensors;

said individual secondary tubes are in further fluid communication with said individual two-way valves;

said two-way valves are in fluid communication with said primary tube;

said primary tube is in fluid communication with said gas pump and said blow off valve;

said microcontroller can receive and send signal to said blow off valve, said gas pump, said individual two-way valves, said communication device, and/or said individual pressure sensors;

said microcontroller, said gas pump, said blow off valve, said plurality of two-way valves, and said plurality of pressure sensors are all powered by said portable power source; and said plurality of bladder pods are covered by said cover attaching to said base.

14. The inflatable cushion of claim 13 further comprising: said portable power source is a battery.

15. The inflatable cushion of claim 13 further comprising:

said microcontroller is a computer system on a chip that contains an integrated processor, memory (a small amount of RAM, program memory, or both), and input/output peripherals, which are used to interact with said two way valves, said blow-off valve, said communication device, and/or said portable power source.

16. The inflatable cushion of claim 13 further comprising:

said communication device is a device that has the potential of having wired or wireless interconnection of mobile phones, computers, and other electronic devices.

17. The inflatable cushion of claim 13 further comprising:

said plurality of sensors are located inside the cover and base when the cushion is assembled.

* * * * *